United States Patent [19]

Ross, Sr.

[11] Patent Number: 4,821,025

[45] Date of Patent: Apr. 11, 1989

[54] VEHICLE COVER ALARM SYSTEM

[76] Inventor: Lawrence D. Ross, Sr., 4509 S. Honduras St., Los Angeles, Calif. 90011

[21] Appl. No.: 90,562

[22] Filed: Aug. 24, 1987

Related U.S. Application Data

[63] Continuation-in-part of Ser. No. 907,571, Sep. 15, 1986, abandoned.

[51] Int. Cl.[4] ..... G08B 13/14

[52] U.S. Cl. ..... 340/568; 248/291; 307/10.2; 340/426

[58] Field of Search ..... 340/568, 63, 548; 307/10 AT; 248/291, 288.1

[56] References Cited

U.S. PATENT DOCUMENTS

| | | | |
|---|---|---|---|
| 1,449,866 | 3/1923 | Mactyre | 248/288.1 |
| 4,222,032 | 9/1980 | Speer | 340/63 |
| 4,253,084 | 2/1981 | Topputo | 340/568 |
| 4,274,077 | 6/1981 | Feiger | 340/568 |
| 4,698,615 | 10/1987 | Wilber | 340/568 |

*Primary Examiner*—Glen R. Swann, III

[57] ABSTRACT

A vehicle cover alarm apparatus is provided for use on a vehicle equipped with an "electronic security system". The alarm apparatus comprises a bracket which carries an electrical switch. An electrical conductor electrically connects the switch to the electronic security system on the vehicle. A cable is connected to the switch and extends from the switch outwardly of the vehicle. The cable is adapted for connection to a vehicle cover and when so connected, creates a tension on the cable which causes the switch to move to a first switch position. A biasing means such as a spring biases the cable against the action created by the tension on the cable. Thus, when the vehicle cover is released from the cable, the spring will automatically bias the switch to its initial switch position. In this way, the alarm apparatus and the vehicle security system are set in an alarm condition, an unauthorized release of the cable from the vehicle cover will cause the movement of the switch and thereby energize an alarm forming part of the vehicle security system.

13 Claims, 1 Drawing Sheet

VEHICLE COVER ALARM SYSTEM

RELATED APPLICATION

This application is a continuation-in-part of my copending U.S. patent application Ser. No. 06-907,571, filed Sept. 15, 1986 for Car Cover Alarm Security System, now abandoned.

BACKGROUND OF THE INVENTION

1. Field of the Invention

This invention relates in general to certain new and useful improvements in vehicle security apparatus, and more particularly, to an improved vehicle cover alarm apparatus.

2. Brief Description of the Prior Art

In recent years, it has become necessary to install security systems in many automotive vehicles in order to reduce the incidence of theft of the vehicle or portions of the vehicle. These alarm systems can sometimes be rather sophisticated and may generate either light or sound alarms or both in the event of a unauthorized intrusion into the vehicle.

Many vehicle owners, due to the cost of the vehicle, also utilize vehicle covers for protection of the vehicle during inclement weather or at times when the vehicle is not being driven. These vehicle covers are adapted to extend over the major portion of the vehicle and are usually secured to the vehicle along the lower edges of the body of the vehicle. However, these vehicle covers can be rather substantial in size and may be equipped with certain types of fasting means which make them fairly expensive.

In recent years, not only has there been an increased incidence in the theft of vehicles and portions of the vehicles, but there has also been an increased incidence in the theft of automotive vehicle covers. Accordingly, there has been some need to protect the vehicle cover against theft, as well as the vehicle itself.

U.S. Pat. No. 4,274,077 to Feiger discloses a vehicle cover alarm system. However, the apparatus in the Feiger Patent is a self contained alarm system and utilizes expensive sensors forming part of the vehicle cover itself. This, in turn, requires the provision of a specialized vehicle cover, thereby increasing the overall cost of the vehicle cover.

OBJECTS OF THE INVENTION

It is, therefore, one of the primary objects of the present invention to provide a vehicle cover alarm apparatus which may be used with the electronic security system of an automotive vehicle.

It is another object of the present invention to provide a vehicle security cover alarm apparatus of the type stated which is adapted for connection to a structural portion of the vehicle and to the vehicle cover and which causes the generation of an alarm upon unauthorized disconnection of the vehicle cover from the vehicle itself.

It is a further object of the present invention to provide a vehicle cover alarm apparatus of the type stated which is highly reliable in its operation and which can be constructed at a relatively low unit cost.

It is an additional object of the present invention to provide a vehicle cover alarm apparatus of the type stated which relies upon relatively unsophisticated and simple electrical switches, connecting cables and the like.

With the above and other objects in view, my invention resides in the novel features of form, construction, arrangement and combination of parts presently described and pointed out in the claims.

BRIEF SUMMARY OF THE DISCLOSURE

The present invention relates in general terms to a vehicle cover alarm apparatus which is capable of being used on a vehicle equipped with an electronic security system. The alarm apparatus generally comprises a bracket assembly for securement to a desired portion of the vehicle, as for example, in the trunk compartment or engine compartment of the vehicle. An electrical switch means is carried by this bracket. Means is provided for electrically connecting the switch means to the electronic security system of the vehicle. The means for electrically connecting is usually an electrical conductor. Moreover, this electrical conductor is usually connected to some type of detector, as for example, a motion detector forming part of the electrical security system.

A cable, such as a flexible string or the like, is secured to the switch and extends outwardly of the vehicle. The outer end of this cable is adapted for connection to a vehicle cover. For this purpose, a clip or like mechanism may be provided on the outer end of the cable. When the cable is connected to the vehicle cover, there is a tension created in the cable which moves the switch to a switched or "off" condition. A spring is also connected to some fixed portion of the vehicle or to the bracket which pulls the cable thereby biasing the switch back to its initial unswitched or "on" condition. In this way, if the vehicle cover is unauthorizedly released, the electrical switch will be shifted back to its unswitched condition.

When the switch is in the unswitched condition, and the vehicle alarm apparatus is turned on, the electrical circuit of the apparatus is grounded to the vehicle. This will cause a generation of an alarm. However, when the cable is connected to the vehicle cover, a tension is created in the cable and this will cause a movement of the electrical switch to the switched or "off" position. This will avoid a complete electrical circuit through the alarm system, thereby precluding the alarm from generating. However, in the event of an unauthorized disconnection of the vehicle cover, the cable will be pulled by the spring back to its original position, thereby completing the electrical circuit through the switch and thereby causing the generation of an alarm.

This invention possesses many other advantages and has other purposes which may be made more clearly apparent from a consideration of the forms in which it may be embodied. These forms are shown in the drawings forming a part of and accompanying the present specification. They will now be described in detail for the purposes of illustrating the general principles of the invention, but it is to be understood that such detailed description is not to be taken in a limiting sense.

BRIEF DESCRIPTION OF THE DRAWINGS

Figure 1:
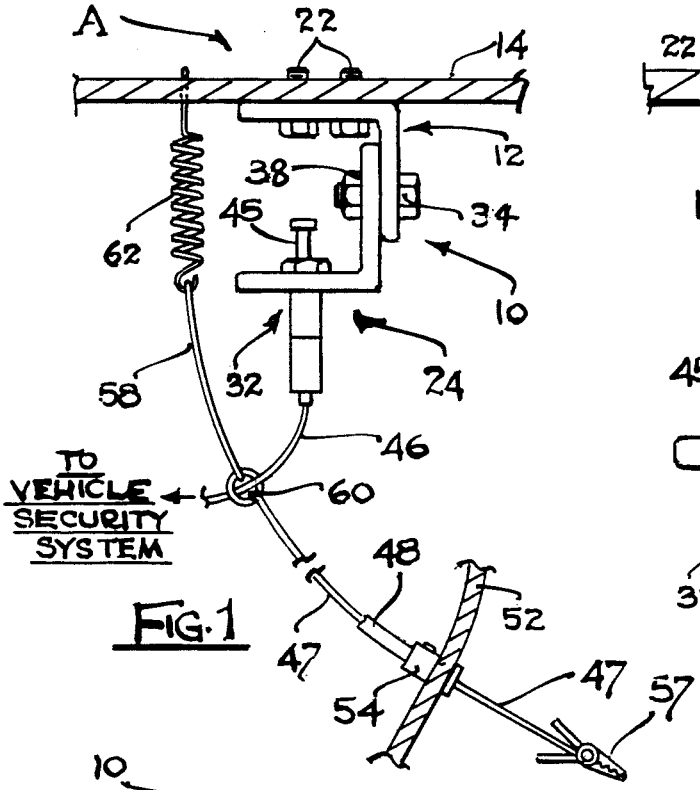
Figure 3:
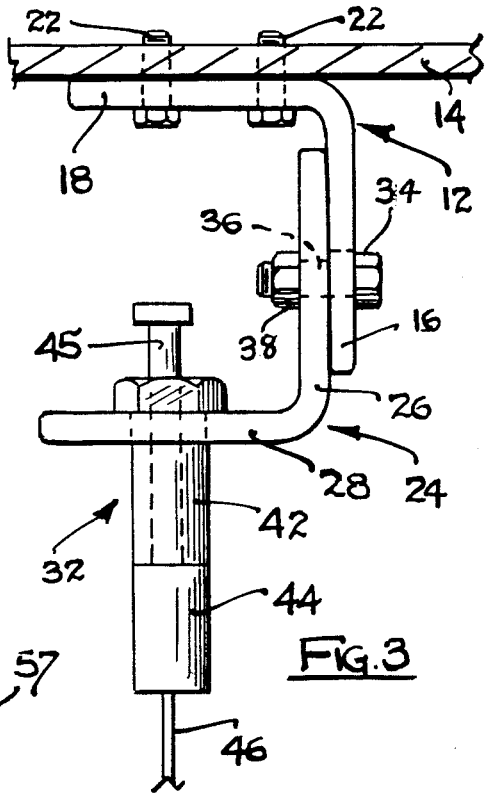
Figure 2:
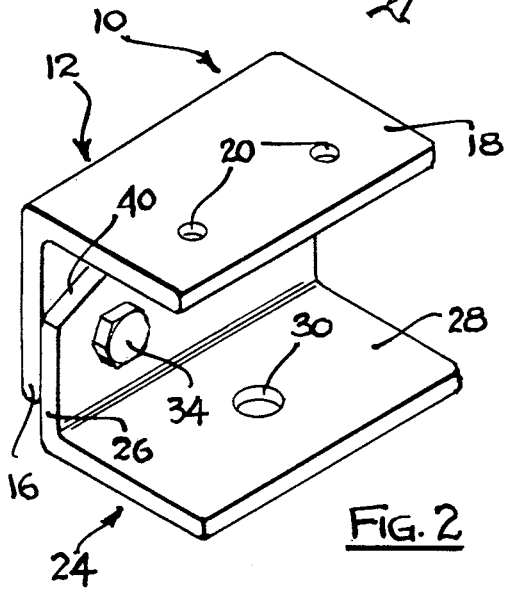
Figure 5:
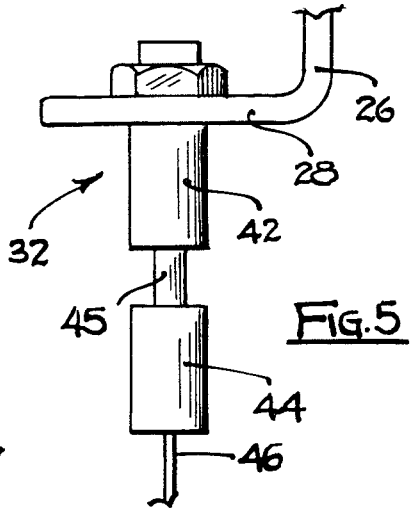
Figure 4:
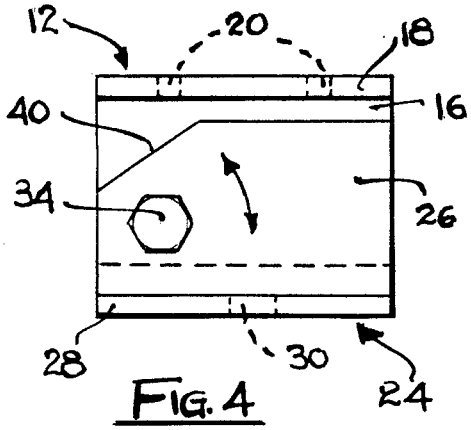
Figure 6:
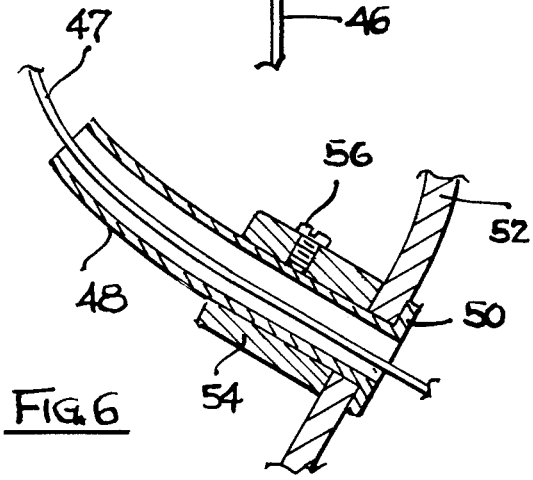

Having thus described the invention in general terms, reference will now be made to the accompanying drawings (1 sheet) in which:

FIG. 1 is a side elevational view, partially in section and showing one embodiment of the vehicle cover alarm apparatus constructed in accordance with and embodying the present invention;

FIG. 2 is a perspective view of a bracket assembly forming part of the vehicle cover alarm apparatus of the present invention;

FIG. 3 is a side elevational view, partially broken away and in section, showing the bracket assembly used in the vehicle cover alarm apparatus and showing a switch forming a part of the alarm apparatus connected thereto;

FIG. 4 is a front elevational view of the bracket assembly of FIG. 2;

FIG. 5 is a fragmentary side elevational view, similar to FIG. 3, and showing the electrical switch thereof in the electrically open position; and FIG. 6 is an enlarged sectional view showing a portion of a tube assembly which permits extension of a flexible cable from the switch outwardly of the vehicle.

DETAILED DESCRIPTION OF PRACTICAL EMBODIMENTS

Referring now in more detail and by reference characters to the drawings which illustrate practical embodiments of the present invention, A designates a vehicle cover alarm apparatus which is adapted for use on vehicles, and preferably, for use on automotive vehicles. The vehicle cover alarm apparatus is only capable of being used with vehicles which already have an alarm system, such as an electronic security system, installed therein.

The vehicle cover alarm apparatus of the present invention is quite simple in construction and requires only a relatively limited number of parts which include:

1. Eight pieces of 2" long 1¼" by 1¼" 90 degree angle iron,
2. About 15 feet of 16 gage insulated copper wire,
3. Four hood and trunk auto theft alarm switches,
4. Four 2" alligator clips,
5. 2 to 4 feet of ¼" (quarter inch) copper tubing,
6. Two 4" outside diameter by ¼" loose slip fit inside diameter collars,
7. Six feet of ⅛" diameter string,
8. Four electric ring terminals to crimp to the 16 gage wire and also to tie the string,
9. One small toggle switch,
10. One 2 to 5 amp fuse,
11. ¼" by 5" light spring.

This invention generally comprises a bracket assembly 10, which is more fully illustrated in FIGS. 2–4 of the drawings. The bracket assembly 10 comprises a first L-shaped bracket 12 capable of being secured to a portion of the vehicle, designated by reference numeral 14. This fixed portion may adopt, for example, an upper portion of the vehicle trunk wall. The first bracket is L-shaped and includes a vertically disposed wall 16 and a horizontally disposed upper wall 18. The upper wall 18 is provided with apertures 20 for receiving mechanical fasteners 22. In this way, the first bracket 12 may be mounted to the vehicle in any desired orientation by first mounting the bracket through one of the mechanical fasteners 22. When the first bracket 12 is in the desired orientation, then the second mechanical fastener 22 would be extended through the second aperture 20 for securing the first bracket 12 in a desired position.

The mechanical fasteners may adopt any conventional form of mechanical fasteners, such as screws, bolts, or the like. Preferably, the mechanical fasteners may adopt the form of sheet metal screws so that they may be easily secured to the structure of the automotive vehicle.

The bracket assembly 10 generally comprises a second bracket 24 which is somewhat similar to the bracket 12. This bracket 24 includes a first flat plate 26 which is abutted against the flat surface of the plate 16, in the manner as illustrated in FIGS. 2 and 3 of the drawings. The bracket 24 also includes an outwardly extending leg 28 which is located parallel to the plate 18 when the brackets are arranged in the position shown in FIGS. 2 and 3. In this way, when the two brackets are connected together, they form a C-shaped bracket assembly 10, when in the relative positions in the manner as illustrated in FIGS. 2 and 3 of the drawings.

The bracket 24 is provided with an enlarged opening 30 in the leg 28 to receive an electrical switch 32, hereinafter described in more detail. In addition, the bracket 24 is secured to the bracket 12 by a pivot means 34 which may adopt the form of a bolt extending through aligned apertures in the walls 16 and 26. In this way, inasmuch as there is only one bolt which functions as a pivot means, the second bracket 24 can pivot or rotate relative to the first bracket 12. Thus, after the first bracket 12 has been secured in a desire orientation within the vehicle, the user of the assembly can then secure the second bracket 24 to the first bracket 12 in a desired orientation and secure the same thereto by means of the bolt 34. The bolt 34 preferably includes a shank 36 extending through the plates 16 and 26 and is tightened on its opposite end by means of a nut 38.

By reference to FIGS. 2–4 of the drawings, it can be observed that the flat plate 26 of the second bracket 24 is generally rectangular in shape. In like manner, the vertically disposed flat plate 16 of the first bracket 12 is also generally rectangularly shaped. However, the vertically disposed plate 26 of the second bracket 24 has an inclined edge 40 extending from its upper margin to one of its side margins, in the manner as best illustrated in FIGS. 2 and 4 of the drawings. This inclined edge 40 will provide the necessary amount of clearance for adjustment. In this way, the second bracket 24 may be rotated about the pivot, created by the bolt 34, in a direction as shown by the arrow in FIG. 4. This inclined wall allows sufficient clearance for the bracket 24 to the rotated to a desired position relative to the bracket 12.

The bracket assembly 10 is designed to carry the electrical switch 32, in the manner as more fully illustrated in FIGS. 3 and 5 of the drawings. The electrical switch 32 comprises a first switch element 42 and a second switch element 44 which is moveable with respect to the first switch element along an axially extending rod 45. The first switch element 42 is electrically conductive and is electrically grounded. The second switch element 44 is also electrically conductive. The rod 45, which allows movement of the second switch element 44 relative to the first switch element 42, is electrically insulated or electrically non-conductive. In this way, the switch elements 42 and 44 are capable of cooperating as an electrical switch. When in the closed position, as illustrated in FIG. 3, the switch creates a grounded condition through an electrical conductor 46 thereby creating a complete circuit path through the vehicle body to an alarm forming part of the security system. However, when the second switch element is separated from the first switch element 42 in the manner as illustrated in FIG. 5, then there is no grounded condition, and hence, an incomplete electrical circuit path through the electrical conductor 46.

The conductor 46 is connected to the electronic security system previously installed in the automotive vehicle. More preferably, the electrical conductor 46 is connected to a sensor, such as a motion sensor, forming part of the security system of the vehicle. In this way, the alarm forming part of that security system may be used as the alarm in the vehicle cover alarm apparatus forming part of the present invention.

In accordance with the above identified construction, it can be observed that when the first switch element 42 is in contact with the second switch element 44 as shown in FIG. 3, then any electrical circuit would be grounded through the vehicle. This will permit a complete electrical circuit to an alarm apparatus (not shown). As a result, if the security system, and hence, the automotive vehicle cover alarm apparatus is armed, then an alarm will be generated. However, when the second switch element 44 is moved away from the first switch element 42, as shown in FIG. 5, then there is no grounding to the vehicle and hence, an incomplete electrical circuit path to the vehicle security system and hence, to the automotive vehicle cover alarm apparatus. Accordingly, there would be no operation of the alarm forming part of the security system.

A string or cable 47 is capable of pulling the second switch element 44 away from the first switch element 42 in the manner as shown in FIG. 5. This cable 47 extends through a tube, such as a copper tube 48, as shown in FIGS. 1 and 6. The tube is designed to guide the cable 47 outwardly of the vehicle, in the manner as more fully illustrated in FIG. 6. The copper tube 48 is malleable and may be formed, that is, rolled or bent to a desired configuration in order to receive and accommodate the cable in a variety of different types of installations. The outer end of the tube 48 is provided with a flared end 50 for engagement against the exterior surface of a wall 52 forming part of the vehicle. The tube 48 is also secured against this wall 52 by means of a collar 54 having a set screw 56. Thus, when the set screw 56 is tightened against the tube 48, the collar 54 and the flared end 50 of the tube 48 will hold the tube 48 securely in place. The cable 46 may then be easily threaded through the tube 48.

The outer end of the cable 47 is provided with a clip 57 for connection to a vehicle cover (not shown). A suitable clip may adopt the form of a so-called "alligator clip", which is easily connected to the vehicle cover. However, it should be understood that any form of mechanism for securing the cable to the vehicle cover could be employed.

The cable 47 is also biased so that the switch 32 is moved to the closed switch position, as shown in FIG. 3. The cable 47 is provided with a cable extension 58 connected thereto by a conventional ring member 60. Moreover, the cable section 58 is connected to a spring 62 which is also connected to a fixed structural portion of the automotive vehicle, such as the wall 14, in the manner as illustrated in FIG. 1.

When installing the vehicle cover alarm apparatus of the invention, the mounting bracket assemblies 10 are installed in unobtrusive or out of the way positions. Usually, it is desirable to mount these brackets at the extreme left and extreme right sides of the trunk so that the brackets and cables will not be in the way. If a metal surface is not immediately available, it would be desirable to connect a ground wire to one of the brackets and to the vehicle itself.

In accordance with the above identified construction, it can be observed that when the cable 47 is secured to a vehicle cover through the alligator clips 57 or other fastening means, then tension is created in the cable pulling the switch element 44 away from the switch element 42, thereby opening the switch 32.

As indicated previously, the cable 47 is provided with a cable extension 58, that is, the cable 47 is connected to the cable 58 through the ring 60. Pulling on the cable 47 constitutes a pulling on cable 58. If desired, the electrical ring terminal or so called "ring" 60 could be crimped to the conductor 46 such that pulling on the cable 47 would cause a pulling action on the cable 46. In this way, there is no possibility of creating a completed electrical circuit through the vehicle cover alarm apparatus to any alarm forming part of the vehicle security system. When the alarm system is still activated and any one or more of the clips 57 are released from the vehicle cover, the spring 62 associated with that cable will cause the cable 46 to be pulled upwardly, thereby permitting the switch element 44 to be moved into contact with the switch element 42. As this occurs, a completed electrical circuit is created to the alarm forming part of the vehicle security system. When the security system is armed, the alarm will generate a sound or visible light or both, thereby alerting the owner of the vehicle to a possible intrusion or theft in the vehicle.

After the bracket has been installed, the copper tubing 48 is inserted through a hole located near the trunk as close to the bracket as possible. With a metal flaring tool, one end of the copper tube is flared and then inserted in the hole formed in the wall of the vehicle, so that the flare abuts the outer surface of the metal wall of the vehicle. The tube may then be formed or bent to the desired shape. However, before bending the tube, the collar 54 may be slipped over the inner end of the tube and abutted against the wall 52 of the vehicle. Thereafter, the set screw 56 is tightened to secure the collar in place. Thereafter, the outer end of the tube may be flared.

In order to install the brackets 10, it is preferable to insure that the switch assemblies 32 are installed in the brackets before making any final adjustment and final drilling of any of the two holes for the mechanical fasteners, such as sheet metal screws. The copper tubes 48 are bent to the required contour so as to be in alignment with the required angles of the cables 47. The copper tube 48, even when mounted, will be able to swivel either to the left or right in order to aid in adjustment.

Additional bracket assemblies and switches are then mounted to the vehicle walls, as for example, in the trunk and engine compartments of the vehicle. Preferably, four such assemblies are mounted with two mounted in the trunk compartment and two mounted in the engine compartment. In this way, four cables will be located in a quadrilateral arrangement for connection to the vehicle cover.

Thereafter, 16 gage electrical wire is used for connection to each of the electrical switches. The wires should be long enough to reach the motion detectors forming part of the vehicle security circuit forming part of the vehicle which will trigger the alarm. Furthermore, a 2 amp to 5 amp fuse should be located in this circuit arrangement. In addition, an additional toggle switch maybe located in the circuit between the switch 32 and a fuse holder. The fuse holder would be located between the toggle switch and the motion detector in a desired arrangement.

All four switch assemblies, including the associated bracket assemblies, must be installed in such a way that when the alligator clips are pulled toward the ground surface, they will pull the cables 4 connected to the switch assemblies 32. Moreover, the cables 47 must be sufficiently long to reach the bottom margins of the vehicle cover. In addition, the spring 62 must be tied to the cable 47 in such a way that it will pull the clips 57 back in place, thereby keeping the cover in a taut condition. Moreover, the springs 62 must be sufficiently strong to pull the cable 47 and hence the switch section 44 into contact with the switch section 42 when the cover is removed in order to thereby sound the alarm.

The vehicle cover alarm apparatus of the present invention can be provided in the form of a kit which is easily installed. Moreover, it has a minimum number of components so that it is relatively inexpensive. Thus, this vehicle cover alarm apparatus is highly advantageous in that it can be provided at a low cost, and does not include internal sensors, but can utilize the existing security system of the automotive vehicle.

Thus, there has been illustrated and described a unique and novel vehicle cover alarm apparatus which may be used in conjunction with a vehicle security system and which thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations, and other uses and application which do not depart from the spirit and scope of the invention are deemed to be covered by the invention.

Having thus described the invention, what I desire to claim and secure by Letters Patent is:

1. A vehicle cover alarm apparatus for use on a vehicle equipped with a vehicle electronic security system, said alarm apparatus comprising:

(a) bracket means for securement to the vehicle, (b) an electrical switch carried by said bracket means, (c) means for electrically connecting said switch to the electronic security system equipped on the vehicle, (d) a cable connected to said switch and extending from said switch outwardly of said vehicle and being adapted for connection to the vehicle cover and which creates a tension on said cable through said connection and opens said switch, and (e) biasing means biasing said cable against the tension created by connection to the vehicle cover and which enables said switch to be closed when the cover is disconnected from the cable thereby releasing the tension in the cable.

2. The vehicle cover alarm apparatus of claim 1 further characterized in that a clip is on the end of said cable outwardly of said vehicle for releasable connection to a vehicle cover.

3. The vehicle cover alarm apparatus of claim 1 further characterized in that said biasing means is a spring.

4. The vehicle cover alarm apparatus of claim 1 further characterized in that a plurality of bracket means and associated electrical switches are secured to said vehicle at a plurality of spaced apart locations on said vehicle.

5. The vehicle cover alarm apparatus of claim 1 further characterized in that a tube is secured to a wall of the vehicle and said cable extends through said tube outwardly of said vehicle.

6. The vehicle cover alarm apparatus of claim 1 further characterized in that said tube is secured to the vehicle wall with a surrounding collar.

7. The vehicle cover alarm apparatus of claim 1 further characterized in that said bracket means comprises a first bracket capable of being secured to the vehicle and a second bracket pivotally secured to said first bracket and capable of being rotated relative to said first bracket.

8. The vehicle cover alarm apparatus of claim 7 further characterized in that said second bracket has an inclined edge enabling said second bracket to be rotated relative to said first bracket.

9. A vehicle cover alarm apparatus for use on a vehicle equipped with an electronic security system, said alarm apparatus comprising:

(a) a first bracket having a flat plate and plurality of mounting apertures for mounting to a fixed structures of a vehicle with a plurality of mechanical fasteners, (b) a second bracket having a flat plate disposed against the flat plate of the first bracket, said second bracket also having an aperture therein, (c) pivot means pivotally connecting said second bracket to said first bracket so that the second bracket can be rotated related to said first bracket, (d) said flat wall of said second plate having an inclined edge so that said second bracket may be rotated relative to said first bracket, (e) an electrical switch carried by said second bracket, (f) means for electrically connecting said switch to the electronic security system on the vehicle, (g) a cable connected to said switch and extending form said switch outwardly of said vehicle and being adapted for connection to the vehicle cover and which creates a tension on said cable through said connection and opens said switch, and (h) biasing means biasing said cable against the tension created by connection to the vehicle cover and which enables said switch to be closed when the cover is disconnected from the cable thereby releasing the tension in the cable.

10. The vehicle cover alarm apparatus of claim 9 further characterized in that a clip is on the end of said cable outwardly of said vehicle for rapid releasable connection to and disconnection from a vehicle cover.

11. The vehicle cover alarm apparatus of claim 10 further characterized in that a plurality of pairs of first and second brackets and associated electrical switches are secured to said vehicle at a plurality of spaced apart locations on said vehicle.

12. The vehicle cover alarm apparatus of claim 11 further characterized in that a tube is secured to a wall of the vehicle and said cable extends through said tube outwardly of said vehicle.

13. The bracket assembly of claim 12 further characterized in that said first and second brackets are each L-shaped angle brackets.

* * * * *